US006877885B2

(12) United States Patent
Eusterbrock

(10) Patent No.: US 6,877,885 B2
(45) Date of Patent: Apr. 12, 2005

(54) FLOOR LAMP HAVING IMPROVED DIMMER CONFIGURATION

(76) Inventor: Paul Eusterbrock, 155 Hardman Ave., St. Paul, MN (US) 55075

( * ) Notice: Subject to any disclaimer, the term of this patent is extended or adjusted under 35 U.S.C. 154(b) by 0 days.

(21) Appl. No.: 10/600,680

(22) Filed: Jun. 20, 2003

(65) Prior Publication Data

US 2004/0062048 A1 Apr. 1, 2004

Related U.S. Application Data

(60) Provisional application No. 60/390,700, filed on Jun. 20, 2002.

(51) Int. Cl.[7] ..... F21S 8/08

(52) U.S. Cl. ..... 362/411; 362/395; 362/414; 362/295

(58) Field of Search ..... 362/411, 395, 362/394, 414, 410, 802, 295, 413, 552, 285, 449, 418, 431, 433

(56) References Cited

U.S. PATENT DOCUMENTS 5,165,785 A * 11/1992 Doong ..... 362/295
5,620,247 A * 4/1997 Swanson ..... 362/414
5,800,054 A * 9/1998 Lo ..... 362/431
5,863,111 A * 1/1999 Turner et al. ..... 362/410
D474,557 S * 5/2003 Eusterbrock ..... D26/61
D492,444 S * 6/2004 Eusterbrock ..... D26/107

* cited by examiner

*Primary Examiner*—Thomas M. Sember
*Assistant Examiner*—Bao Q Truong
(74) *Attorney, Agent, or Firm*—Oppenheimer Wolff & Donnelly LLP

(57) ABSTRACT

The floor lamp of the present invention includes a dimmer switch at a mid-point of the main supporting post in order to allow maximum accessibility for the users. The dimmer switch is contained within a compact and aesthetically pleasing dimmer housing, and is appropriately connected via electrical connections which extend through the main supporting post. An additional supporting post is provided, which runs from the base portion of the floor lamp to the dimmer housing to add structural stability to the floor lamp. By utilizing the dimmer switch in an elevated location, the need for mechanical connecting rods is eliminated. Further, additional design freedom is obtained.

16 Claims, 4 Drawing Sheets

FLOOR LAMP HAVING IMPROVED DIMMER CONFIGURATION

This application claims the benefit of provisional application Ser. No. 60/390,700 filed on Jun. 20, 2002.

BACKGROUND OF THE INVENTION

In the field of lighting fixtures, it is a commonly accepted and efficient practice to utilize dimmer switches in order to vary the intensity of light produced. The use of a dimmer switch, however, often complicates design possibilities as the dimmer itself is often a relatively large component, which must be placed somewhere in the light fixture.

With floor lamps, there is a need for a fairly substantial base portion that supports the remainder of the floor lamp. As can be appreciated, this base portion must have a substantial dimension so that forces can be appropriately distributed, while also having sufficient weight to stabilize the floor lamp. Due to these already existing requirements, the base portion is a very convenient spot to house the dimming switch mechanism. Further, while placing the dimming switch in the base itself, several design options are preserved.

From the design perspective, it has often been difficult to provide a dimmer switch location other than the base. Often there is a desire for sleek, non-bulky supporting posts and the inclusion of large housings or large structures within or on these posts is very undesirable. Furthermore, the placement of the dimmer near the bulb itself is often undesirable as it is not easily accessible to the user. In addition, excessive heat produced by the bulb can adversely affect the life expectancy of the dimmer switch.

Placing the dimmer switch at an intermediate location along the post of the lamp is often ideal as this position is accessible by a user who is either seated or standing. In the past, one approach to achieve this dimmer switch placement is to provide a switch or knob having a long connecting rod that extends down to the base. This long rod then connects with the actual dimming switch electronics and mechanisms in order to achieve an operable dimming mechanism. This configuration allows the electronics of the dimming switch mechanism to be contained within the base while also providing accessibility. As can be appreciated however, the existence of a long actuating arm or rod creates additional complications. Specifically, the rod must be supported and structured to contain all additional forces that may be generated. Further, the actuating rod must transfer forces to the dimming switch, which may include large amounts of torque along the rod's length.

SUMMARY OF THE INVENTION

In order to achieve an aesthetically pleasing floor lamp design, while also providing also providing the desired functionality. The floor lamp of the present invention includes a dimmer switch at a mid-point of the supporting rod in order to allow maximum accessibility for the users. The dimmer switch is contained within a compact and aesthetically pleasing dimmer housing, and is appropriately connected via electrical connections that extend through the main supporting post. By utilizing the dimmer switch in this location, the need for mechanical connecting rods is eliminated. Further, additional design freedom is obtained.

While elimination of a feature such as a mechanical connecting rod can be obtained, the similar feature could also be utilized from a design perspective, even using the lamp of the present invention.

One advantage of the invention is the convenient placement of the dimmer switch in conjunction with the design flexibility afforded. Further, the need for a functional actuating rod is eliminated.

DETAILED DESCRIPTION OF PREFERRED EMBODIMENTS

Figure 1:
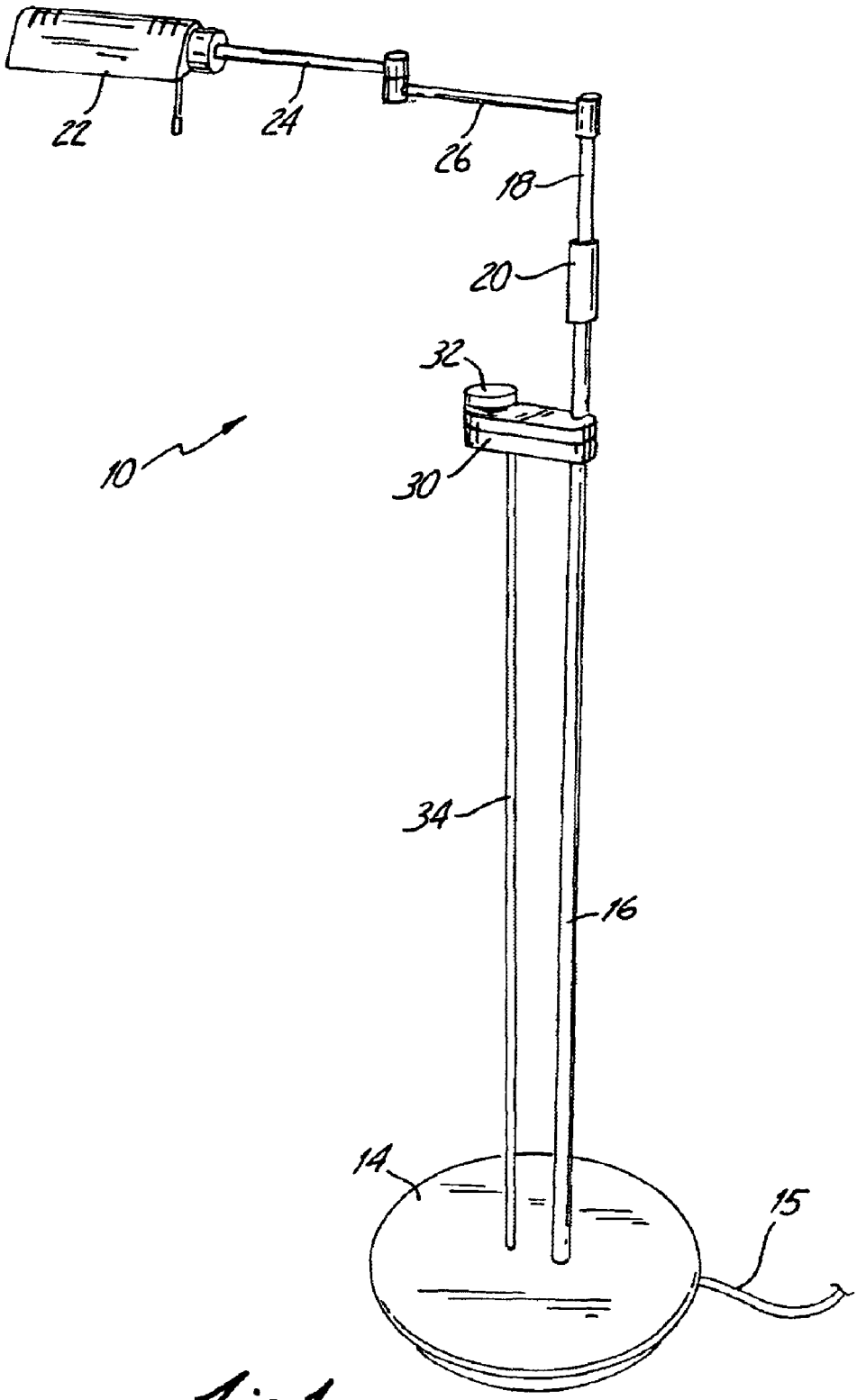
FIG. 1 is a perspective view of one embodiment of a floor lamp having the improvements of the present invention.
Figure 2:
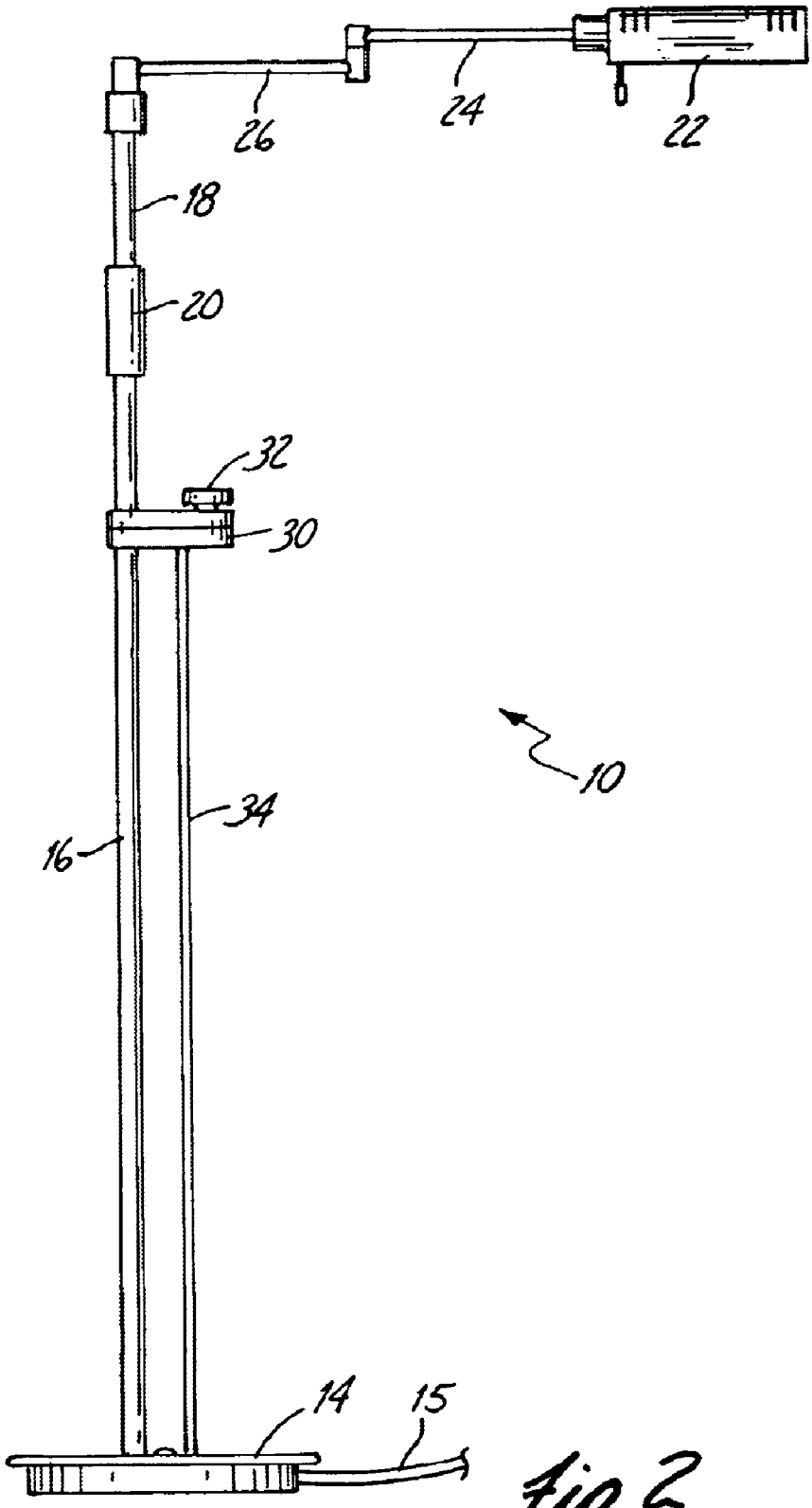
FIG. 2 is a side view of the floor lamp shown in FIG. 1.
Figure 3:
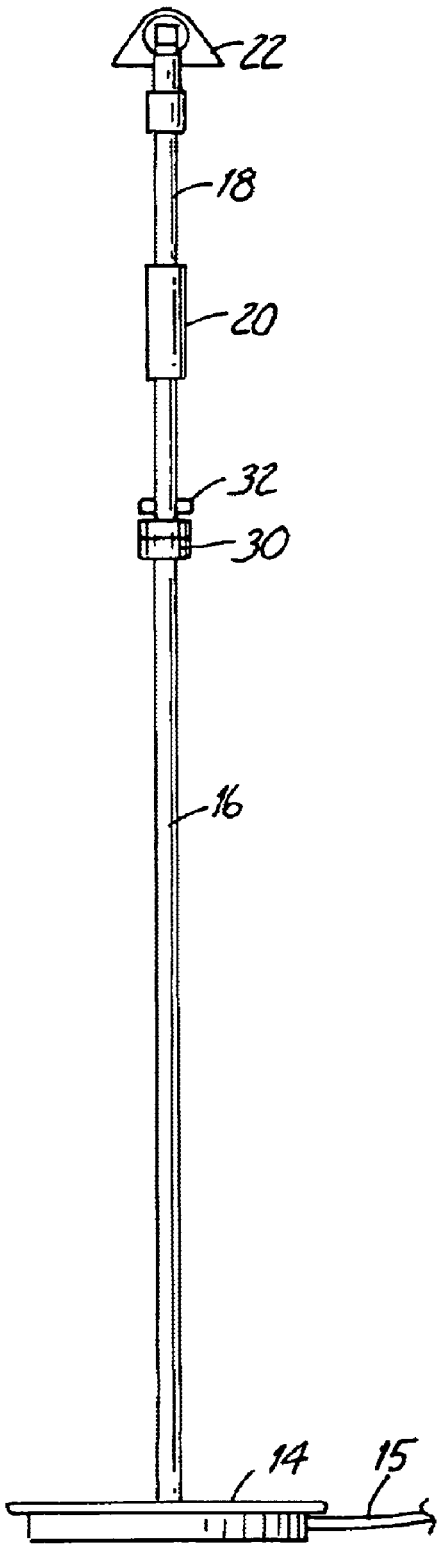
FIG. 3 is a rear view of the floor lamp shown in FIG. 1.
Figure 4:
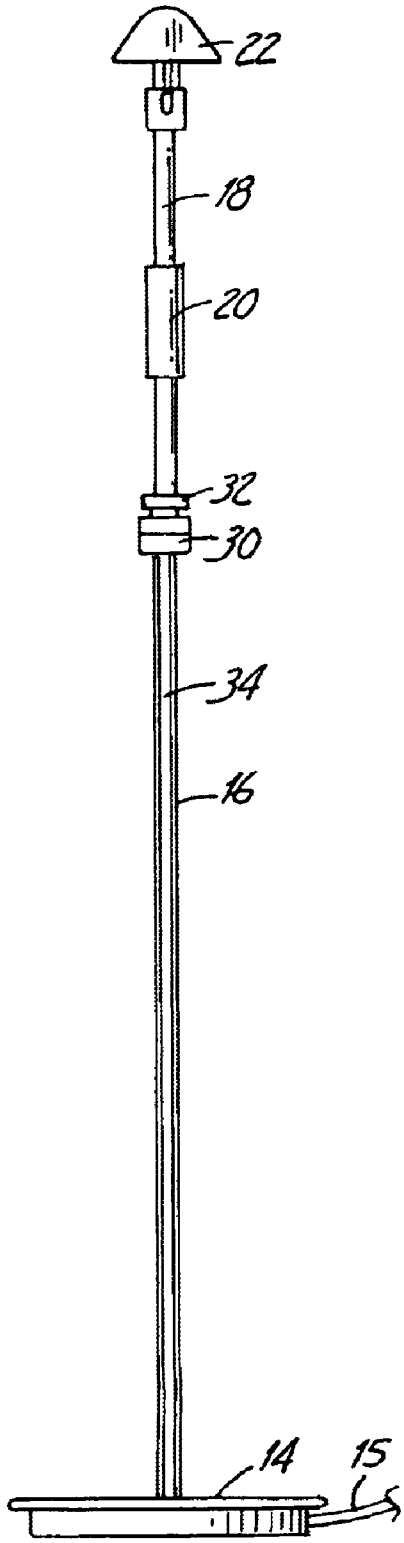
FIG. 4 is a front view of the floor lamp shown in FIG. 1.
Figure 5:
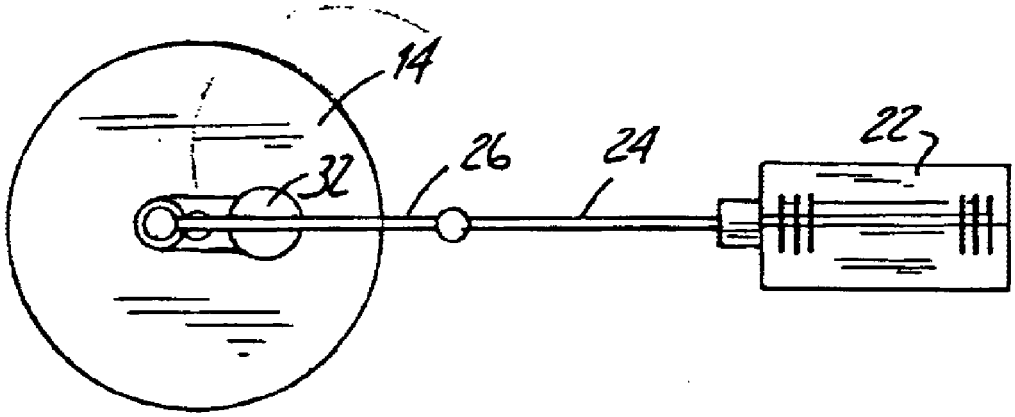
FIG. 5 is a top view of the floor lamp shown in FIG. 1.
Figure 6:
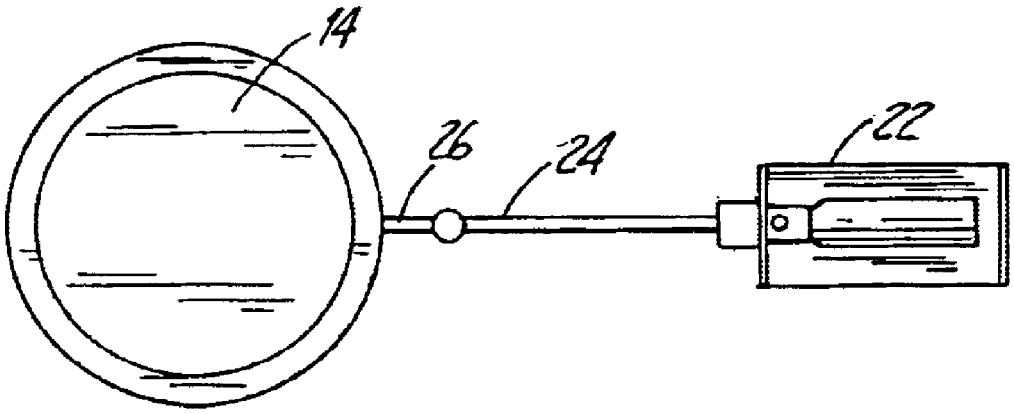
FIG. 6 is a bottom view of the floor lamp shown in FIG. 1.

Referring now to the Figures that illustrate one embodiment of the present invention which includes a floor lamp 10 having the desired features of the present invention. More specifically, the floor lamp 10 includes a base portion 14 along with a first supporting post 16, extending upwardly therefrom. Naturally, an electrical connecting cord 15 would provide operating power to the floor lamp 10. The first supporting post 16 attaches to a second supporting post 18 via a connecting element 20. In this particular embodiment, the second supporting post 18 is adjustable and, therefore, allows the height of the floor lamp to be adjusted upwardly and downwardly. In this particular embodiment, a lampshade assembly 22 and a pair of swing arms 24 and 26 are attached to the second supporting post 18. As will be appreciated, within the lampshade assembly 22 is the lighting socket and light bulb which provide the light source (not shown).

Attached to the first supporting post 16 are dimmer housing 30 and a dimmer knob 32. The dimmer housing 30 contains the dimmer switch which provides dimming capabilities to the lamp. Extending downwardly from dimmer housing 30 is a third supporting post 34 which provides additional structural stability to this particular floor lamp. The dimming functionality is contained within dimmer housing 30, thus the third supporting post 34 is purely structural and aesthetic in nature. It will appreciated that all types of design possibilities could be achieved utilizing this design.

As mentioned above, the dimmer housing 30 contains the dimming switch. Due to the size of such switch mechanisms, this type of configuration has not previously been possible. This is especially true when the dimmer housing 30 has a relative size of roughly 3 inches by 2 inches by 2 inches. This particularly provides design advantages. More specifically, the dimmer mechanism can be placed in a space that is much smaller than previously required. This allows dimmer housing 30 to be stylish and reasonably sized.

In addition to the size of the dimmer housing, the embodiment shown in the figures has the ability to place dimmer knob 32 directly above the third supporting post 34. In this configuration, it has the appearance of a long-extending control rod attached to dimmer knob 32. Naturally, this is not actually required, thus avoiding complications related to such dimmer control mechanisms.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A floor lamp having an improved dimmer configuration, the floor lamp comprising:

a base portion which supports the floor lamp;

a first supporting post wherein the distal end of the first supporting post is attached to the base portion, and wherein the first supporting post extends upward from the base portion;

a connecting element attached to a proximal end of the first supporting post;

a second supporting post attached to a proximal end of the connecting element, wherein the second supporting post is extendable thereby allowing the height of the lamp to be adjusted upwardly and downwardly;

a pair of swing arms attached to a proximal end of the extendable post;

a lampshade assembly attaching to a distal end of the swing arms;

a dimmer housing attached between a proximal end and the distal end of the first supporting post and a proximal end of the second supporting post, wherein the first supporting post extends upwardly through the dimmer housing;

a dimmer knob rotatably mounted to the top of the dimmer housing a dimmer switch contained within the dimmer housing, wherein the dimmer switch controls the brightness of a light bulb; and a third supporting post with a proximal end of the second supporting post attached to the dimmer housing and a distal end of the second supporting post attached to the base portion.

2. The floor lamp of claim 1, wherein an electrical cord provides operating power.

3. The floor lamp of claim 1, wherein the dimmer switch provides dimming capabilities to the lamp.

4. The floor lamp of claim 1, wherein the third supporting post provides additional structural stability to the floor lamp.

5. The floor lamp of claim 1, wherein the first supporting post has a conduit for enabling an electrical connecting cord to extend through said floor lamp.

6. The floor lamp of claim 1, wherein the lampshade assembly includes a housing, a lighting socket, and the light bulb, wherein the lighting socket and the light bulb are located within the housing.

7. The floor lamp of claim 1 wherein the dimmer housing is positioned on top of the third supporting post.

8. A floor lamp having an improved dimmer configuration, the floor lamp comprising:

a base portion which supports the floor lamp;

a first supporting post wherein the distal end of the first supporting post is attached to the base portion, and wherein the first supporting post extends upward from the base portion;

a connecting element attached to a proximal end of the first supporting post;

a second supporting post attached to a proximal end of the connecting element;

a lighting assembly attaching to a proximal end of the second supporting post;

a dimmer housing attached between a proximal end and the distal end of the first supporting post and a proximal end of the second supporting post, wherein the first supporting post extends upwardly through the dimmer housing;

a dimmer knob rotatably mounted to the dimmer housing a dimmer switch contained within the dimmer housing and attached to the dimmer knob, wherein the dimmer switch controls the brightness of a light bulb; and a third supporting post with a proximal end of the second supporting post attached to the dimmer housing and a distal end of the second supporting post attached to the base portion.

9. The floor lamp of claim 8, wherein an electrical cord provides operating power.

10. The floor lamp of claim 8, wherein the dimmer switch provides dimming capabilities to the lamp.

11. The floor lamp of claim 8, wherein the third supporting post provides additional structural stability to the floor lamp.

12. The floor lamp of claim 8, wherein the first supporting post has a conduit for enabling an electrical connecting cord to extend through said floor lamp.

13. The floor lamp of claim 8, wherein the lighting assembly includes a pair of swing arms, wherein a proximal end of the swing arms is attached to the proximal end of the second supporting post.

14. The floor lamp of claim 8, wherein the lighting assembly comprises a lampshade assembly, wherein the lampshade assembly includes a housing, a lighting socket, and the light bulb, wherein the lighting socket and the light bulb are located within the housing.

15. The floor lamp of claim 8, wherein the second supporting post is extendable thereby allowing the height of the lamp to be adjusted upwardly and downwardly.

16. The floor lamp of claim 8 wherein the dimmer housing is positioned on top of the third supporting post.

* * * * *